United States Patent [19]

Klazar

[11] 4,443,913

[45] Apr. 24, 1984

[54] CREEL

[75] Inventor: Jaroslav Klazar, Pretoria, South Africa

[73] Assignee: GLP Industrial Property Bureau, Udine, Italy

[21] Appl. No.: 285,466

[22] Filed: Jul. 21, 1981

[30] Foreign Application Priority Data

Jul. 25, 1980 [ZA] South Africa ..... 80/4520

[51] Int. Cl.[3] ..... B65H 67/04; D01H 9/02

[52] U.S. Cl. ..... 19/159 A

[58] Field of Search ..... 19/159 A, 243, 0.25

[56] References Cited

U.S. PATENT DOCUMENTS

| | | | |
|---|---|---|---|
| 3,063,101 | 11/1962 | Andreani | 19/243 |
| 3,125,782 | 3/1964 | Kaino et al. | 19/159 A |
| 3,199,152 | 8/1965 | Tooka et al. | 19/159 A |
| 3,562,867 | 2/1971 | Kaiser | 19/243 |
| 4,012,893 | 3/1977 | Weber | 19/159 A |
| 4,059,185 | 11/1977 | Weber | 19/159 A |
| 4,065,831 | 1/1978 | Huntsinger | 19/0.25 |

FOREIGN PATENT DOCUMENTS

| | | | |
|---|---|---|---|
| 1143742 | 2/1963 | Fed. Rep. of Germany | 19/159 A |
| 1785281 | 2/1972 | Fed. Rep. of Germany . | |
| 1318717 | 12/1963 | France . | |
| 4735328 | 1/1969 | Japan | 19/159 A |
| 910761 | 11/1962 | United Kingdom . | |
| 942278 | 11/1963 | United Kingdom . | |
| 1003808 | 9/1965 | United Kingdom . | |
| 1057101 | 2/1967 | United Kingdom . | |
| 1472891 | 5/1977 | United Kingdom . | |

*Primary Examiner*—Louis Rimrodt

*Attorney, Agent, or Firm*—Merchant, Gould, Smith, Edell, Welter & Schmidt

[57] ABSTRACT

The invention provides a creel for feeding slivers (21) of fibers to a processing machine (10), comprising a bank of feed stations (13*c*) to (13*i*) and two reserve feed stations (13*a*) (13*b*). Upon disruption at any feed station in the bank, a reserve feed station comes into operation and is moved into the bank of feed stations, while the station where the feed was interrupted is moved to a reserve feed station position. Movement of the stations is effected by moving a carriage at a station, which includes feed rollers, sensors etc. to the required positions. The carriages are moved along a first rail in an upstream position and a second rail in a downstream position and are transverable between these rails.

13 Claims, 3 Drawing Figures

CREEL

Figure 1:
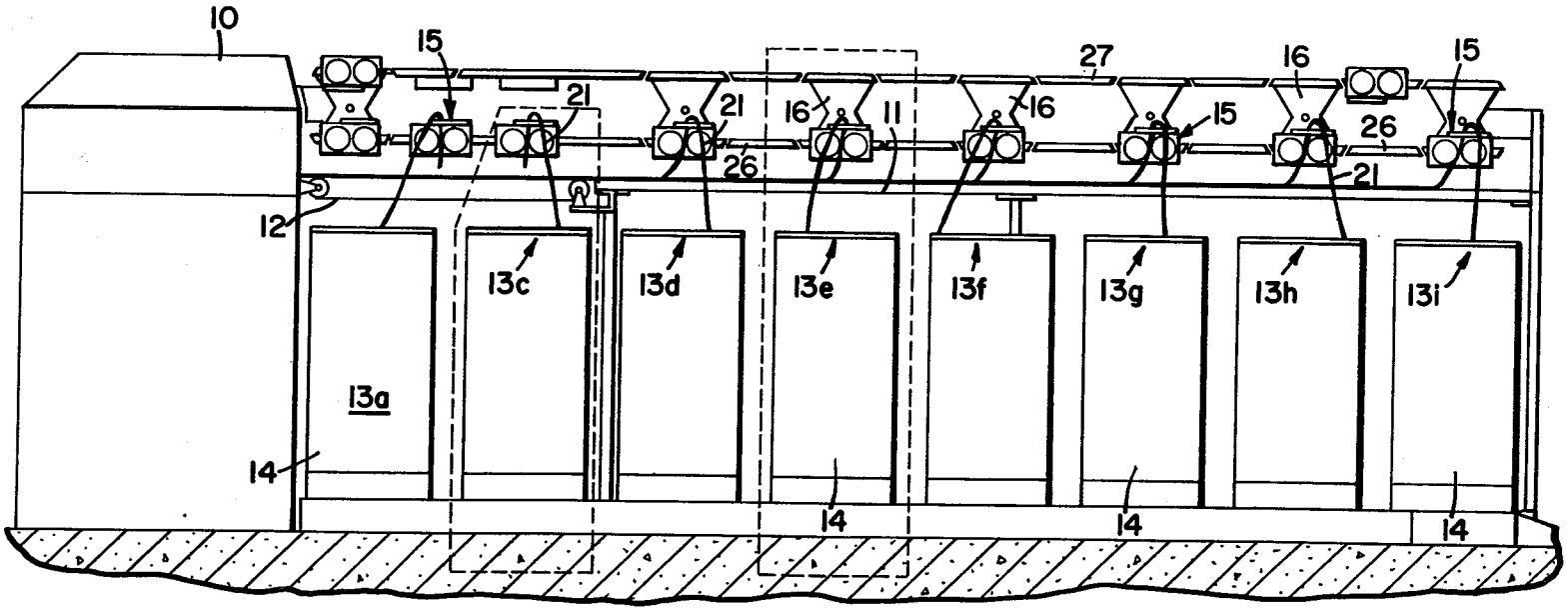

This invention relates to a creel. The term "creel" herein means an assembly adapted to feed one or more slivers or the like of fibre to a processing machine such as a gillbox, drawframe etc.

With conventional ball and can creels, a spent sliver ball or sliver containing can is replaced manually. Piecing-up of slivers after a breakage or can replacement is also done manually requiring the sliver processing machine to be stopped for intervals. With modern high speed gilling and drawing machines, any stoppage causes a considerable loss in production and efficiency.

Attempts have been made to mechanise and automate sliver creels, particularly in cotton processing where draw frames operate at high speeds. Thus the complete specification of British Pat. No. 942 278 discloses an arrangement wherein a circular type creel is proposed in an attempt to ensure continuous sliver input into a processing machine.

British Pat. Nos. 910,761, 1,057,101 and 1,003,808 also disclose circular type creels in different embodiments. All the above suffer from the common disadvantage that, should a sliver break, manual intervention is required. It is moreover believed that the arrangements described are unstable and should their can change cycles become disturbed, for example by a variation of the ideal can load, the creel operation would be interrupted.

It is accordingly an object of the present invention to provide a novel creel which it is believed will result in substantial continuity of sliver feed to a sliver processing machine.

According to the invention a creel comprises a plurality of feed stations arranged in a bank for feeding slivers of fibres to a sliver provessing machine, a reserve feed station for feeding a reserve sliver to the machine upon disruption of sliver feed at any feed station, and means for entering the reserve feed station upon operation thereof, into the bank of feed stations.

Further according to the invention means are provided for removing the station where feed was interrupted from the bank.

Preferably also more than one reserve feed station will be provided to cater for situations where the feed of more than one sliver is interrupted.

Further according to the invention sensor means is provided for detecting a disruption of sliver feed. In one example the sensor means may include an idler roller or the like, or be in the nature of photoelectric cells or the like.

Also according to the invention each feed station includes a carriage member for drawing a sliver by means of rollers or other feed means, from a sliver reservoir and delivering the sliver to a pathway leading to the processing machine. The sliver reservoir may, for example, be in the nature of a sliver ball or a sliver containing can or the like.

Still further according to the invention the feed stations are arranged in side by side relationship adjacent the pathway, with the reserve feed station disposed in closest proximity to the processing machine. Preferably the feed stations may be arranged in a line angled relative to the longitudinal axis of the pathway so that slivers are delivered onto the pathway alongside one another.

Yet further according to the invention the carriage members are movable upstream and downstream relative to the processing machine, towards the station most remote from the machine and towards the reserve feed stations respectively, so that in the event of feed at a station being interrupted its carriage member can be moved downstream from the bank to a reserve station position while the carriage members downstream therefrom can be moved upstream to refill the bank. Feed could be interrupted by the breakage of a sliver or through a sliver reservoir being exhausted.

Further still according to the invention a first track is provided for moving a carriage member in an upstream direction and a second track for moving the carriage member in a downstream direction, with means being provided for moving a carriage member from a locked position into operative engagement with the first or second track as desired. Preferably the tracks are constituted by a single endless track extending between the reserve and remote feed stations. In one arrangement the means for moving a carriage member into engagement with the tracks comprises an arm member pivotally mounted for angular movement between the tracks.

It is further intended to include within the scope of this invention a method of feeding slivers of fibres to a sliver processing machine in a continuous fashion comprising the steps of providing a plurality of sliver feed stations arranged in a bank, and a reserve sliver feed station: feeding slivers from the feed stations to the processing machine, providing means for detecting an interruption in sliver feed at any station, and feeding a sliver from the reserve feed station to the machine, upon detecting a feed interruption, removing the station where feed was interrupted from the bank of feed stations and introducing the reserve station into the bank.

Further according to the invention the method includes the step of utilising the station where feed was interrupted as a new reserve station upon its effective replacement by the reserve station.

Still further according to the invention, the reserve station is located in an extreme downstream position relative to the sliver feed direction and bank of feed stations, and upon feed disruption at a station, the reserve station and any stations in the bank intermediate it and the inoperative station, move upstream to occupy the inoperative station position and thus provide a full complement of feed stations for the bank. It is envisaged that the inoperative station will move downstream from the bank to occupy the reserve station position. Preferably two reserve stations will be provided, the second reserve station being disposed in an extreme downstream position and the first reserve station one position upstream from the second reserve station, the arrangement being one wherein upon utilisation of the first reserve station, the second reserve station will move upstream to occupy the position vacated by the first reserve station, while the inoperative feed station will move downstream to occupy the position vacated by the second reserve station.

Figure 2:
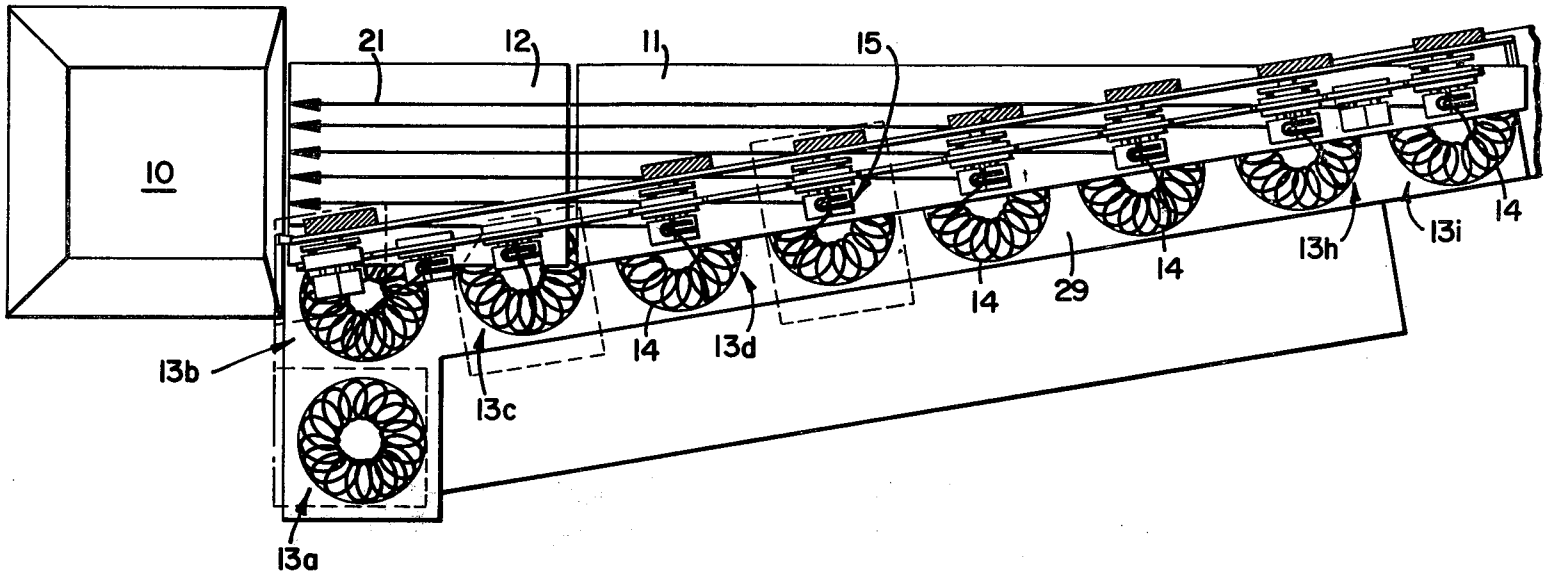
Figure 3:
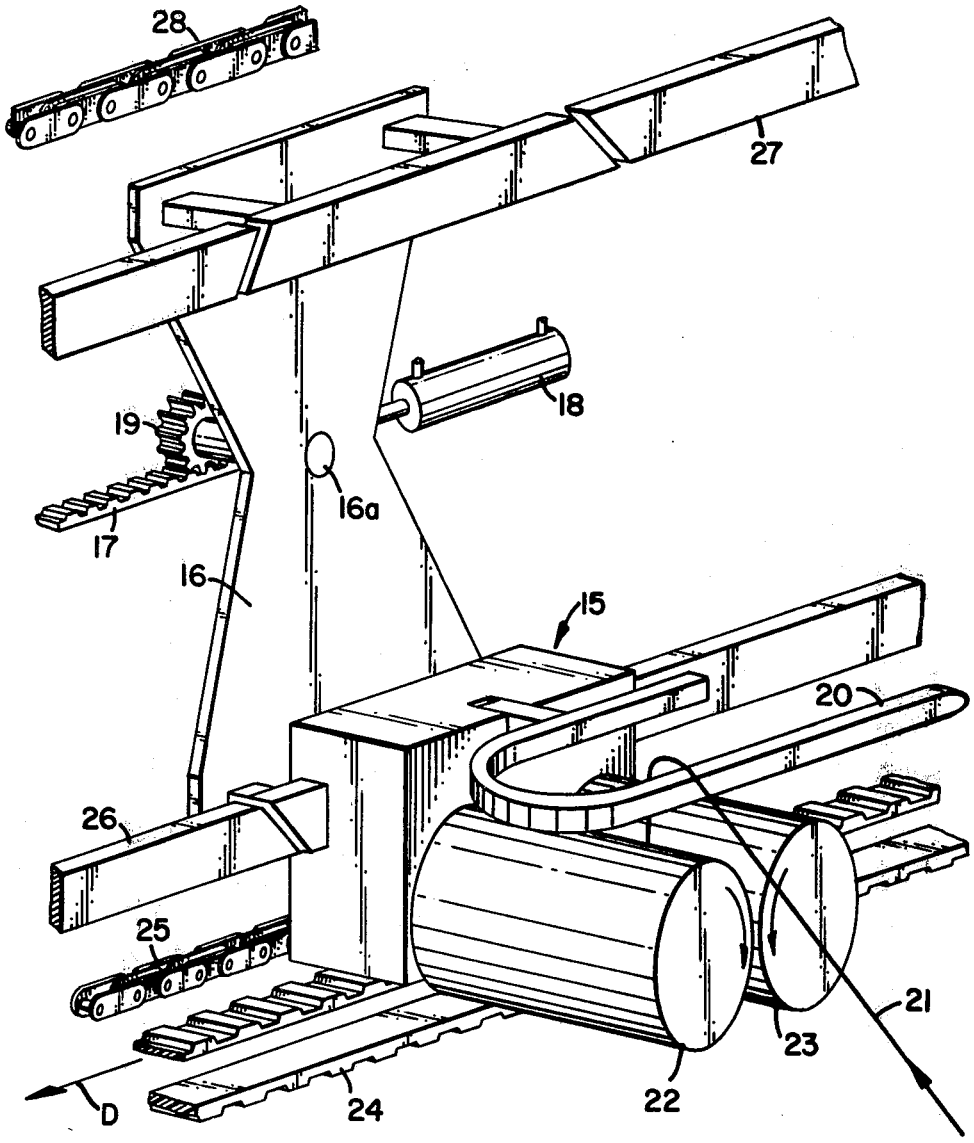

In order to illustrate the invention an embodiment thereof is described hereunder with reference to the accompanying drawings, wherein FIG. 1 is a schematic elevation of a creel secured to a sliver processing machine, FIG. 2 is a schematic plan view of the creel in FIG. 1, and FIG. 3 is an enlarged perspective view of portion of the creel in FIG. 1.

Referring to the drawings a creel for feeding slivers of fibre 21 to a sliver processing machine 10 includes a sliver pathway comprising a stationary table 11 which terminates at its leading end in a moving table 12. In the arrangement in FIG. 1, the moving table is in the nature of an endless belt conveyor which leads to the sliver processing machine 10. A plurality of feed stations designated 13*d* to 13*i* are arranged in a line angled to the longitudinal axis of the table 11, adjacent thereto. Preceding the feed stations 13*d* to 13*i* are a pair of reserve feed stations designated 13*b* and 13*c*.

In use the feed stations 13*d* to 13*i* feed slivers 21 onto the table 11, the slivers 21 being drawn along the table 11 by the processing machine 10. As a result of the angle of the stations relative to the axis of the table 11, the respective slivers will be deposited one alongside the other, as illustrated. Each feed station 13 is disposed above a removable sliver containing bin 14 from which the sliver is drawn. The bins 14 are arranged on a bin conveyor shown schematically at 29 for movement away from the machine 10. A loaded reserve can is provided at a buffer station 13*a* which is disposed adjacent the first reserve feed station 13*b*, as shown in FIG. 2.

Each feed station 13 includes a carriage member 15 which is releasably secured to a pivotally mounted arm 16 which is capable of rotating about its pivotal axis 16*a* under the influence of a ram operable rack 17 and pinion 19 (FIG. 3). The carriage 15 includes a pair of rollers 22 and 23 which define a nip between them for drawing the sliver 21 from a bin 14 and feeding the sliver onto the platform 11. The carriage 15 also includes a guide ring 20 which serves to guide the sliver 21 as illustrated. One roller 22 is driven by means of a moving belt 24 while the other roller 23 is biased towards the roller 22, to derive its rotation from friction between itself and the sliver 21. The roller 23 can thus act as a sensor to sense whether a sliver is passing through the nip defined by the rollers, or not.

The carriage 15 is capable of two types of movement, one being along a rail 26, FIG. 3, in which case it is engaged by a moving chain 25 for such movement. Alternatively, the carriage 15 may be swung through a 180° arc by means of the pivotally mounted arm 16, onto the rail 27 where it is engaged for movement by a moving chain 28. With reference to FIG. 1, a carriage 15 is thus capable of moving downstream towards the feed station 13*i* or upstream towards the reserve feed station 13*b*.

In use the creel described above is loaded as follows. A first loaded can 14 is introduced at the can station 13*a* while the carriage 15 at 13*i* is rotated through 180° and returned via the rail 27 to the first reserve feed station 13*b*. At the same time the carriages at stations 13*b* to 13*h* are each moved one station along the rail 26, while the can at 13*a* is introduced into the first reserve station 13*b* and moved, together with its carriage 15, to the second reserve feed station 13*c*. At this point a second loaded can 14 is introduced into the station 13*a* and the process repeated. Loaded cans are thus introduced until each station, including station 13*a*, is provided with a loaded can. As each can reaches station 13*b* during the loading process its sliver is threaded through the rollers of its carriage 15, either manually or automatically.

Once all the stations are loaded the sliver processing machine 10 is activated as well as the feeding rollers of the respective carriers. It will be appreciated that by virtue of threading the slivers through the carriages when these were in the process of passing the station 13*b*, the leading ends of all the slivers will be disposed in this region on the moving conveyor 12 which acts to lead the slivers to the machine 10. In the event of feed being interrupted at one of the stations, say station 13*e*, as a result of a sliver breakage, or as a result of exhaustion of the can 14, the second reserve feed station 13*c* will commence feeding as the trailing end of the sliver from 13*e* reaches the station 13*c*. It will be appreciated that this can readily be achieved by providing each feed station with a feed sensor which is adapted to activate one of the reserve feed stations 13*b* or 13*c* after an appropriate delay. Once the station 13*e* stops feeding, its carrier 15 is rotated through 180° onto the track 27 for transport towards the first reserve feed station 13*b*. At the same time the can at 13*e* is ejected and the feed stations upstream from station 13*e* moved downstream by one station. The can at station 13*a* can then be moved into the station 13*b* while a fresh can is introduced at 13*a*. Where the stoppage was a result of sliver breakage, the rejected can from 13*e* could be re-introduced at 13*a*.

Doubtless many variations of the invention in detail exist and it is envisaged that these all fall within the scope of the consistory clauses.

It will be appreciated that suitable mechanical and/or electrical control means will be provided to control operation of the creel in its automatic or semi-automatic form. In particular it is envisaged that the control means may comprise a dedicated microprocessor.

I claim:

1. A creel comprising a plurality of feed stations, arranged in a bank, for feeding slivers of fibres to a sliver processing machine, a reserve feed station for feeding a reserve sliver to the machine upon disruption of sliver feed at any station, means for removing the station where feed is interrupted from the bank of feed stations, means for entering the reserve feed station, upon operation thereof, into the bank of feed stations, each of said feed stations including a carriage member for drawing a sliver by means of rollers or other feed means, from a sliver reservoir and delivering the sliver to a pathway leading to the processing machine, the carriage members being movable for purposes of entering or removing a station from the bank of feed stations, said carriage members being movable upstream and downstream relative to the processing machine such movement being respectively towards the station most remote from the machine and towards the station in closest proximity to the machine, so that in the event of feed at a station being interrupted, its carriage member can be moved downstream from the bank of stations to a reserve station position while the carriage members downstream therefrom and the reserve station carriage member can be moved upstream to refill the bank.

2. The creel according to claim 1 wherein a first track is provided for moving a carriage member in an upstream direction and a second track for moving the carriage member in a downstream direction, with means being provided for moving a carriage member from the first or second track as desired.

3. The creel according to claim 2 wherein means for moving the carriage between the tracks comprises an arm member pivotally mounted between the tracks for angular movement.

4. The creel according to claim 3 wherein the arm member includes sections or inserts of the two tracks in opposed relationship so that angular movement of the arm member through substantially 180° will move each such section from one track to the other, and the carriage is adapted to be disposed on such track sections for purposes for transfer from one track to the other.

5. The creel according to claim 6 wherein drive means in the form of a moving chain or the like is provided for moving the carriage members along the tracks.

6. A creel comprising a plurality of feed stations arranged in a bank for feeding slivers of fibres to a sliver processing machine, each of said feed stations including a carriage member having feed means for drawing a sliver from a sliver reservoir and delivering the sliver to a pathway leading to the processing machine, sensor means being operatively interconnected to said feed stations for detecting a disruption of sliver feed at any of the feed stations, removing means operatively interconnected to said feed stations for removing the feed station wherein a disruption of sliver feed occurs upon detection of the disruption, further means for entering a reserve feed station into the bank of feed stations upon removal of the feed station wherein a disruption occurs, said reserve feed station being activated to feed a sliver of fibre to the sliver processing machine so as to provide a full compliment of feed stations.

7. A creel in accordance with claim 6, wherein said carriage members are movable along a track member for purposes of entering or removing a feed station from the bank of feed stations.

8. A creel in accordance with claim 7, wherein the carriage members are movable along a first track member in an upstream direction away from the sliver processing machine and a second track member in downstream direction toward the sliver processing machine, said carriage members being transferrable between said first and second track members.

9. A creel in accordance with claim 8, said reserve feed station prior to being activated and placed into operation being located downstream from the bank of feed stations, said reserve station being moved along said first track member when entered into the bank of operative feed stations actively feeding slivers to the processing machine.

10. The creel according to claim 6, wherein the sensor means comprises an idler roller or the like which is adapted to signal a stoppage.

11. The creel according to claim 6 wherein means is provided to initiate detecting feed from a reserve station in such a manner that the leading end of the reserve sliver will substantially link up with the tail end of the disrupted sliver.

12. The creel according to claim 11 wherein the means comprises a microprocessor.

13. The creel according claim 6 wherein the feed stations are arranged in a line angled relative to a longitudinal axis of the pathway so that slivers are delivered onto the pathway alongside one another.

* * * * *

UNITED STATES PATENT AND TRADEMARK OFFICE

CERTIFICATE OF CORRECTION

PATENT NO. : 4,443,913

DATED : April 24, 1984

INVENTOR(S) : Jaroslav Klazar

It is certified that error appears in the above-identified patent and that said Letters Patent is hereby corrected as shown below:

In the Abstract, line 13, "transverable" should be --transferable--.

Column 1, line 15, "mechanise" should be --mechanize--.

Column 1, line 37, "provessing" should be --processing--.

Column 2, line 37, "utilising" should be --utilizing--.

Column 2, line 54, "utilisation" should be --utilization--.

Column 2, line 66, delete "and".

Column 2, line 68, change the period to a semi-colon.

Figure 4:
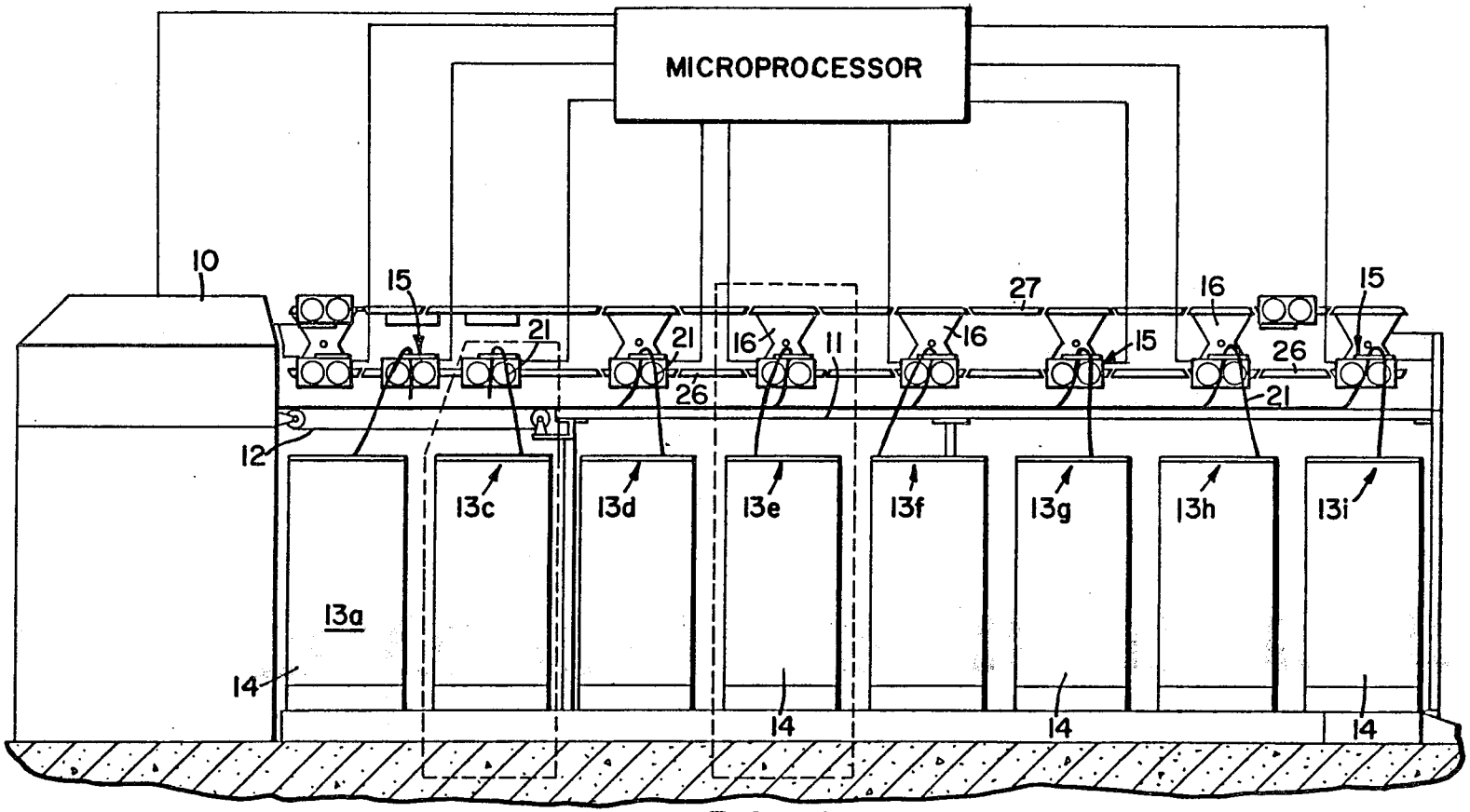

Column 2, at the end of the column, after the description of Figure 3, add the following: --Figure 4 is a view similar to Figure 1 showing the creel utilized in conjunction with a microprocessor.--

Column 6, line 19, "detecting" should be --sliver--.

Signed and Sealed this

*Eleventh* Day of *December 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,443,913

DATED : April 24, 1984

INVENTOR(S) : Jaroslav Klazar

It is certified that error appears in the above-identified patent and that said Letters Patent is hereby corrected as shown below:

On the title page;
The Assignee should be:

South African Inventions Development Corporation,
Pretoria, Republic of South Africa Signed and Sealed this

*Thirtieth* Day of *July 1985*

[SEAL]

*Attest:*

DONALD J. QUIGG

*Attesting Officer* *Acting Commissioner of Patents and Trademarks*